US005871371A

United States Patent [19]

Rothenberger et al.

[11] Patent Number: 5,871,371

[45] Date of Patent: Feb. 16, 1999

[54] HIGH DENSITY CIRCULAR CONNECTOR

[75] Inventors: Richard Ellis Rothenberger, Bainbridge; Mark Joseph Zitto, Mechanicsburg, both of Pa.

[73] Assignee: The Whitaker Corporation, Wilmington, Del.

[21] Appl. No.: 774,863

[22] Filed: Dec. 19, 1996

[51] Int. Cl.[6] ..... H01R 9/05

[52] U.S. Cl. ..... 439/579

[58] Field of Search ..... 439/578, 579, 439/580, 581, 582, 583, 584, 585, 497, 607, 610, 83, 632, 633, 677, 678

[56] References Cited

U.S. PATENT DOCUMENTS

| | | | |
|---|---|---|---|
| 3,980,380 | 9/1976 | Cieniawa et al. | 339/99 R |
| 4,382,653 | 5/1983 | Blanchard . | |
| 4,790,775 | 12/1988 | David | 439/579 |
| 5,082,455 | 1/1992 | Wei | 439/352 |
| 5,199,887 | 4/1993 | Iacono | 439/83 |
| 5,334,031 | 8/1994 | Schmidt | 439/83 |

FOREIGN PATENT DOCUMENTS

| | | | |
|---|---|---|---|
| 0 401 040 A2 | 12/1990 | European Pat. Off. | H01R 23/26 |
| 0 617 487 A1 | 9/1994 | European Pat. Off. | H01R 23/68 |
| 0 724 310 A2 | 7/1996 | European Pat. Off. | H01R 9/05 |
| 396 279 A | 1/1996 | Switzerland . | |

OTHER PUBLICATIONS

CPC (Circular Plastic) and Metal–Shell CPC Connectors, AMP Catalog 73–204 Streamlined 3–90, pp. 8, 10, 17.

CPC (Circular Plastic) and Metal–Shell Circular Plastic Connectors, AMP Catalog 82021, Revised 8–95, p. 24.

International Search Report, International Application No. PCT/US 97/23710, International Filing Date Dec. 17, 1997.

*Primary Examiner*—Steven L. Stephan
*Assistant Examiner*—Yong Ki Kim

[57] ABSTRACT

The invention comprises an electrical connector for providing connection for a plurality of coaxial cable disposed in a shielded cable. The connector includes a contact housing having a plurality of signal and ground contacts mounted therein. The contact housing has an outer periphery. The signal and ground contacts are disposed about the outer periphery of the contact housing. The signal and ground contacts each have contact sections and connection sections for forming an electrical connection with the signal and ground from a coaxial cable.

21 Claims, 10 Drawing Sheets

HIGH DENSITY CIRCULAR CONNECTOR

FIELD OF THE INVENTION

The present invention is directed to a high density circular connector for connecting coaxial cable.

BACKGROUND OF THE INVENTION

Typical circular connectors have pins mounted into an insert within the connectors. Disposed around the insert is a movable coupling nut which can be twisted to allow the coupling nut to threadedly engage the mating receptacle connector. The inserts can have various types of pins received therein to allow connection of both signal, power, and coaxial cables. The mating receptacle connector has a series of socket contacts to engage the pin contacts. These electrical connectors provide a wire to wire connection.

What is needed is a connector which can accommodate a higher density of coaxial signal contacts. What is also needed is an connector system that allows coaxial cable to be connected to a circuit board.

SUMMARY OF THE INVENTION

The invention comprises an electrical connector for providing connection for a plurality of coaxial cable disposed in a shielded cable. The connector includes a contact housing having a plurality of signal and ground contacts mounted therein. The contact housing has an outer periphery. The signal and ground contacts are disposed about the outer periphery of the contact housing. The signal and ground contacts each have contact sections and connection sections for forming an electrical connection with the signal and ground from a coaxial cable.

The invention further comprises an electrical connector with a contact housing having a circular periphery. A plurality of alternating ground and signal contacts are disposed about the periphery of the contact housing. The signal contacts have contact sections and connecting sections for being secured to a signal contact in a coaxial cable. The ground contacts have contact sections. The carrier strip provides a connection section to which a shielding braid of the coaxial cable will be secured and the carrier strip provides a commoning of the ground contacts.

The invention is directed to an electrical connector assembly having a plug connector with a plurality of signal and ground contacts mounted therein. The contact housing has an outer periphery. Signal and ground contacts are disposed about the outer periphery of the contact housing. The signal and ground contacts each have contact sections and connection sections for forming an electrical connection with the signal and ground from a coaxial cable. A receptacle connector has a plurality of contacts disposed about an inner wall to provide an electrical connection with the signal and ground contacts of the plug connector. The contacts of the receptacle connector have connection sections to allow connection to a circuit board, whereby the assembly allows a plurality of coaxial cables to be connected to a circuit board.

BRIEF DESCRIPTION OF THE DRAWINGS

An embodiment of the present invention will now be described by way of example with reference to the accompanying drawings, in which.

DETAILED DESCRIPTION OF THE INVENTION

The present invention is directed to an electrical connector for connecting a plurality of coaxial cables to a printed circuit board. For example, the connector is used for connecting a multi wire cable, wherein the individual coaxial cables are bundled in one shielded cable. Other types of bundled cables may be used with the connector of the present invention in a similar manner. The connection to the circuit board is generally by way of surface mount connections. While the embodiment shows a preferred arrangement of the electrical connectors, it is to be understood that various changes may be made including the fact that the connection to the printed circuit board can be by means other than surface mount, such as by a through hole connection.

The present invention is directed to a plug connector 10 which is secured to a cable 12, the cable 12 is a bundle of coaxial cables which are individually shielded. The plug connector 10 is designed to be mated with receptacle connector 14 which is mounted onto a printed circuit board, not shown.

Figure 1:
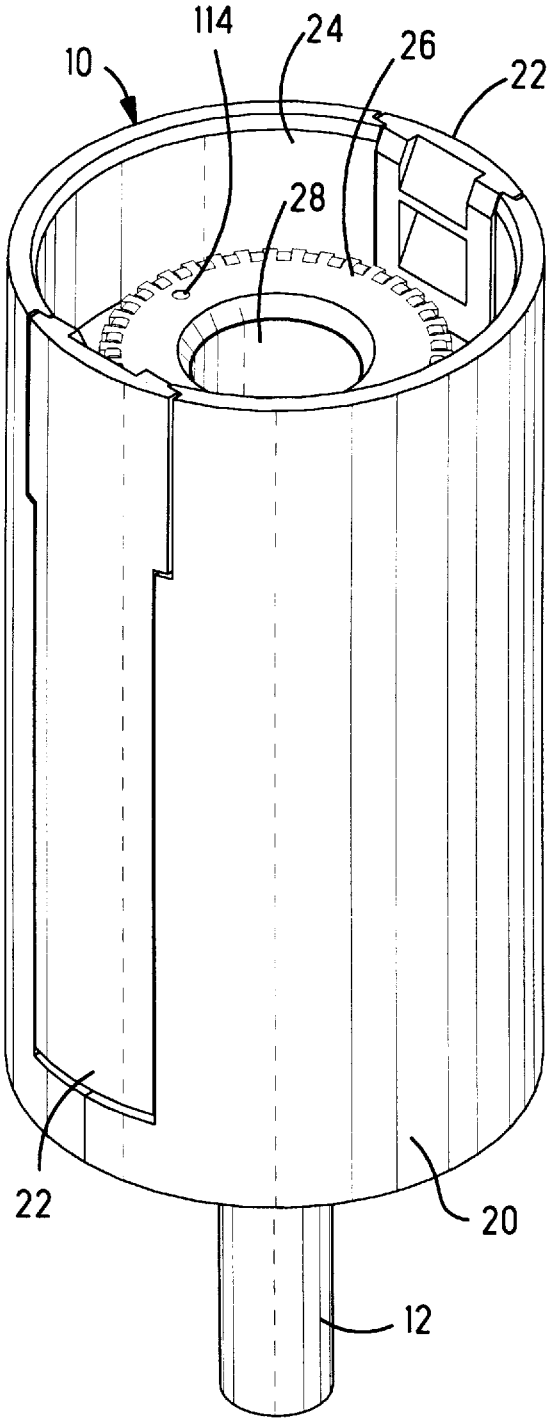
FIG. 1 is an isometric view of the plug connector of the present invention.

FIG. 1 shows the plug connector 10. The plug connector 10 includes a two part housing 20 having two latches 22 disposed along either side of the housing. The housing 20 forms a mating interface 24. Proximate to the mating interface and installed inside the housing 20 is contact housing 26. The contact housing 26 includes a contact array which will be described more fully hereinafter. The contact housing 26 also includes an alignment hole 28 for aligning the connector with the mating receptacle connector.

Figure 3:
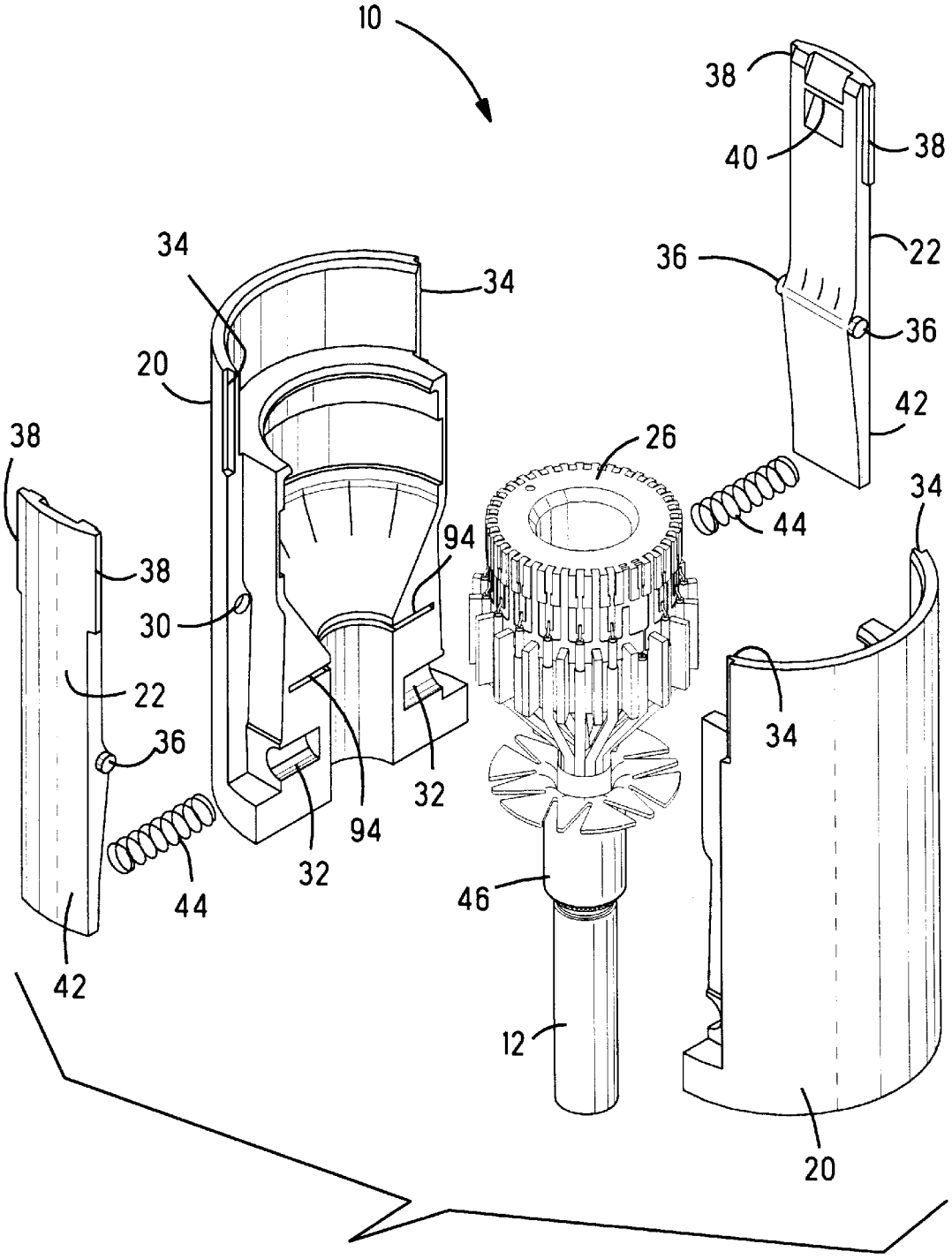
FIG. 3 is an exploded isometric view of the plug connector.

FIG. 3 shows an exploded perspective view of the plug connector 10 of the present invention. As can be seen from this view, the housing 20 is made up of two shells. In this particular instance, the two shells are substantially identical to each other to be received around and form the outer portion of the connector. The housing 20 can either be made of a metallic material to provide shielding or could also be made out of a plastic material depending on the specific application for the connector. When the two halves of the housing 20 are assembled together, a recess is formed along either side into which the latching arms 22 can be assembled. Each of the housings have openings 30, channels 32, and stops 34. The openings 30, channels 32, and stops 34 will be located along each side of the housing 20, however in this view they can be seen only along the one side.

The latching arms 22 have protrusions 36, stops 38, and latching surfaces 40, and pushing surfaces 42. When the latching arm 22 is assembled to the housing 20 the protrusions 36 are received within openings 30 to allow the latching arm 22 to rotate about the protrusions 36. A spring 44 is received within channel 32 The latching surface 40 is received along the top portion of the housing 20 so that stops 38 engage stops 34 on the housing.

In operation the springs 44 press against the bottom, inner surface, or the surface opposite to the pushing surface 42, of the latching arm 22, so that stops 38 on the latching arm engage the stops 34 on the housing. This prevents the latching surfaces 40 from being pushed any further inwardly towards the interior of the housing 20. In order to operate the latching arms 22, it is necessary only to push against the pushing surfaces 42 on the latching arm 22 which will depress the spring 44 and rotate the latching surfaces 40 outwardly away from the interior of the housing 20. This allows release of the mating latching surface on the receptacle contact 14, as described later. Upon release of the pushing surface 42, the latching surface 40 will be pushed back inwardly by the rotation caused from the springs 44 pushing the bottom portion outwardly. This will ensure that the electrical connectors remain secured together and it also allows them to be easily released from each other.

Mounted along the inside of the housing 20 is contact housing 26 which is mounted onto the ends of cable 12. Further, strain relief 46 is mounted onto the cable 12.

Figure 4:
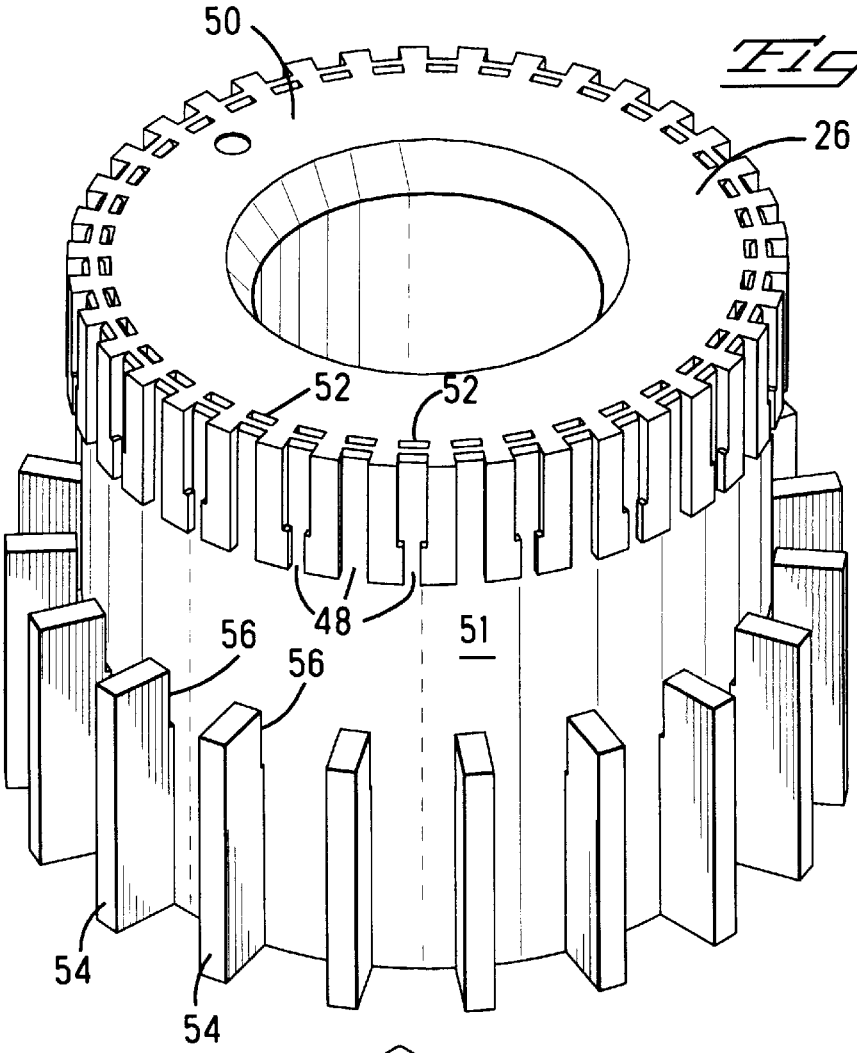
FIG. 4 is an isometric view of the contact housing.

FIG. 4 shows an isometric view of the contact housing 26 of the present invention. The contact housing 26 has a top surface 50 and a circular side surface 51. Along sides of the contact housing are slots 48 to receive contacts therein. The slots 48 extend along the side surface 51 and up through the top 50 of the contact housing 26. Proximate to each slot 48, along the top 50, is a second opening 52 which is used to secure the contacts therein. Towards the bottom of the contact housing, along the sides 51, are ribs 54 which are used to align the individual coaxial cables. Along the top portion of the ribs 54, is a space 56 which extends between the rib 54 and the side surface 51 of the contact housing 26. Each of the ribs 54 have this space along the top end.

Figure 5:
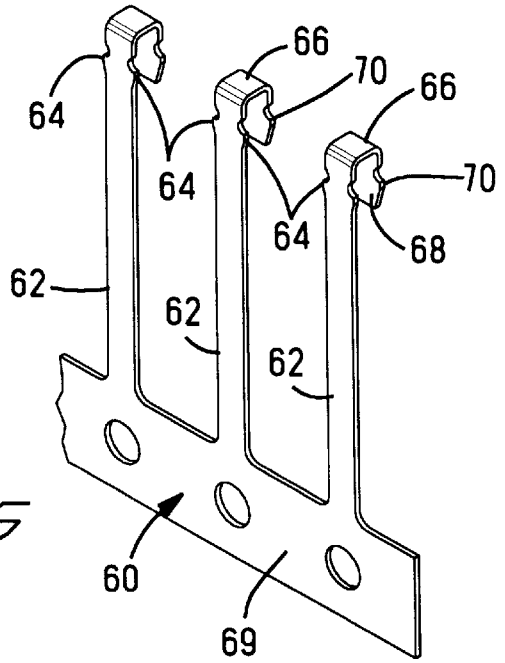
FIG. 5 is an isometric view of the ground contact strip.

FIG. 5 shows a strip of ground contacts which will be secured onto the contact housing 26. Only a partial section of the full ground contact strip 60 is shown in FIG. 5, it is to be understood that the contact strip 60 is long enough to allow the strip 60 to be wrapped around the contact housing 26, as will be described below. The ground contact strip 60 includes a carrier strip 69 with several individual ground contacts 62 extending therefrom, each of the contacts 62 have embossments 64, a bent portions 66, and securing portions 68. Securing portion 68 also has embossments 70 for securing the contact 62 into the contact housing 26.

Figure 6:
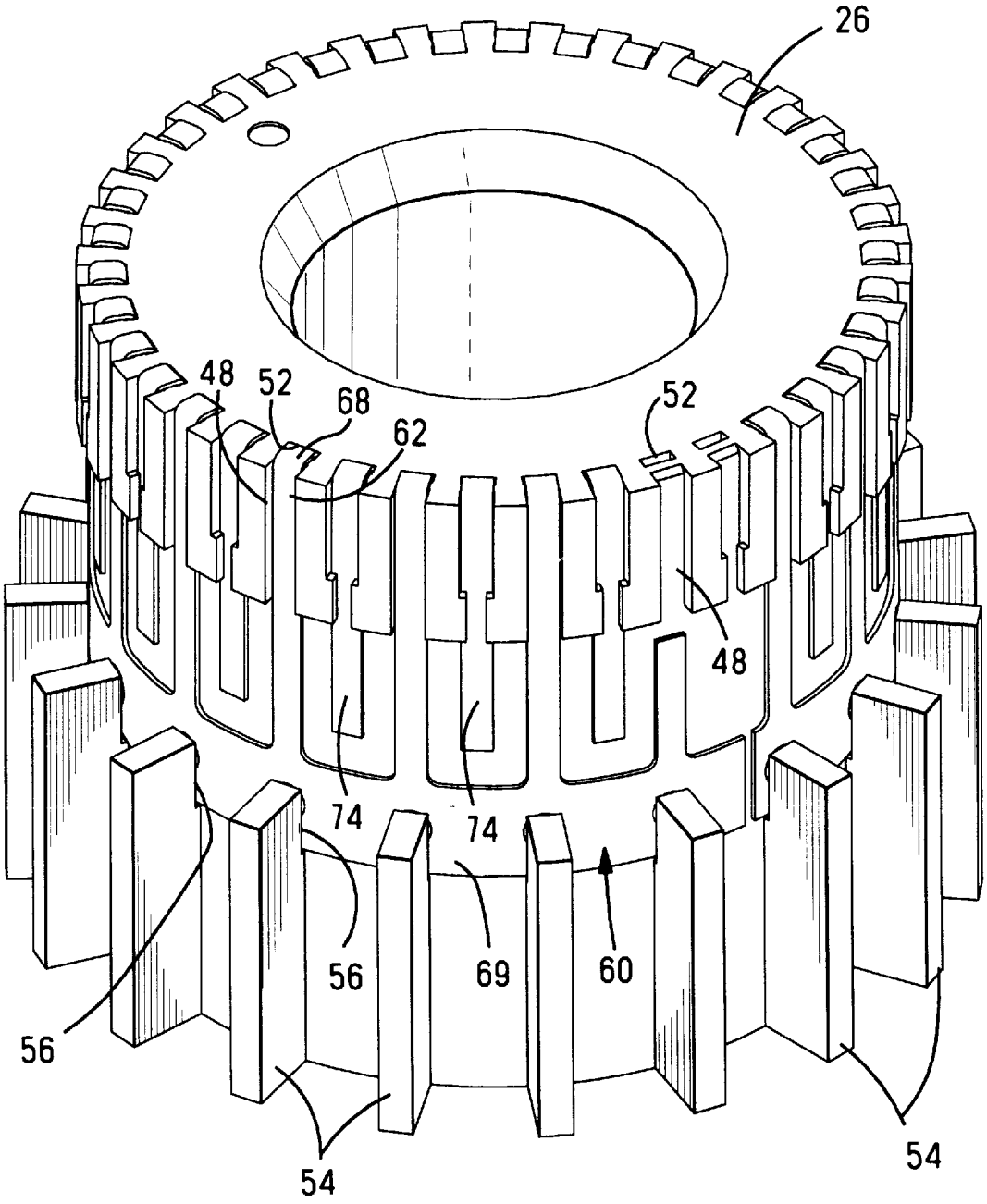
FIG. 6 is an isometric view of the contacts installed in the contact housing.

FIG. 6 shows the contact strip 60 secured to the housing 26. The ground contact strip 60 is assembled to the housing in one piece, the strip being wrapped around the circumference of the contact housing. The strip 60 is long enough so that the strip can be received all the way around the housing 26, or alternatively, it can be somewhat shorter in cases where all of the slots 48 of the contact housing 26 are not utilized. While the resent embodiment shows the contacts 62 as part of a ground contact strip 60, the contacts 62 could also be individual contacts, not connected to each other, and mounted into the contact housing individually. The individual contacts 62 are received within slots 48, the securing portions 68 of the ground contacts 62 are received within openings 52 thereby securing the ground contacts, and therefore the contact strip 60, to the contact housing 26. The carrier strip 69 of the contact strip 60 is received within spaces 56 between the rib 54 and the side of the contact housing 26.

The signal contacts 74 are substantially identical to the ground contact 62, the only difference being that the signal contacts are mounted individually to the contact housing not as a whole strip. The signal contact has embossments and a securing portion with embossments thereon, which are not shown individually, but they are substantially the same as the embossments and the securing portions on the ground contact strip 60. The signal contacts 74 are received within alternating slots 48 and are secured therein in a similar manner to the ground contacts. The assembly of both the signal and ground contacts to the contact housing 26 provides an array of alternating signal and ground contacts about the periphery of the contact housing 26.

Figure 7:
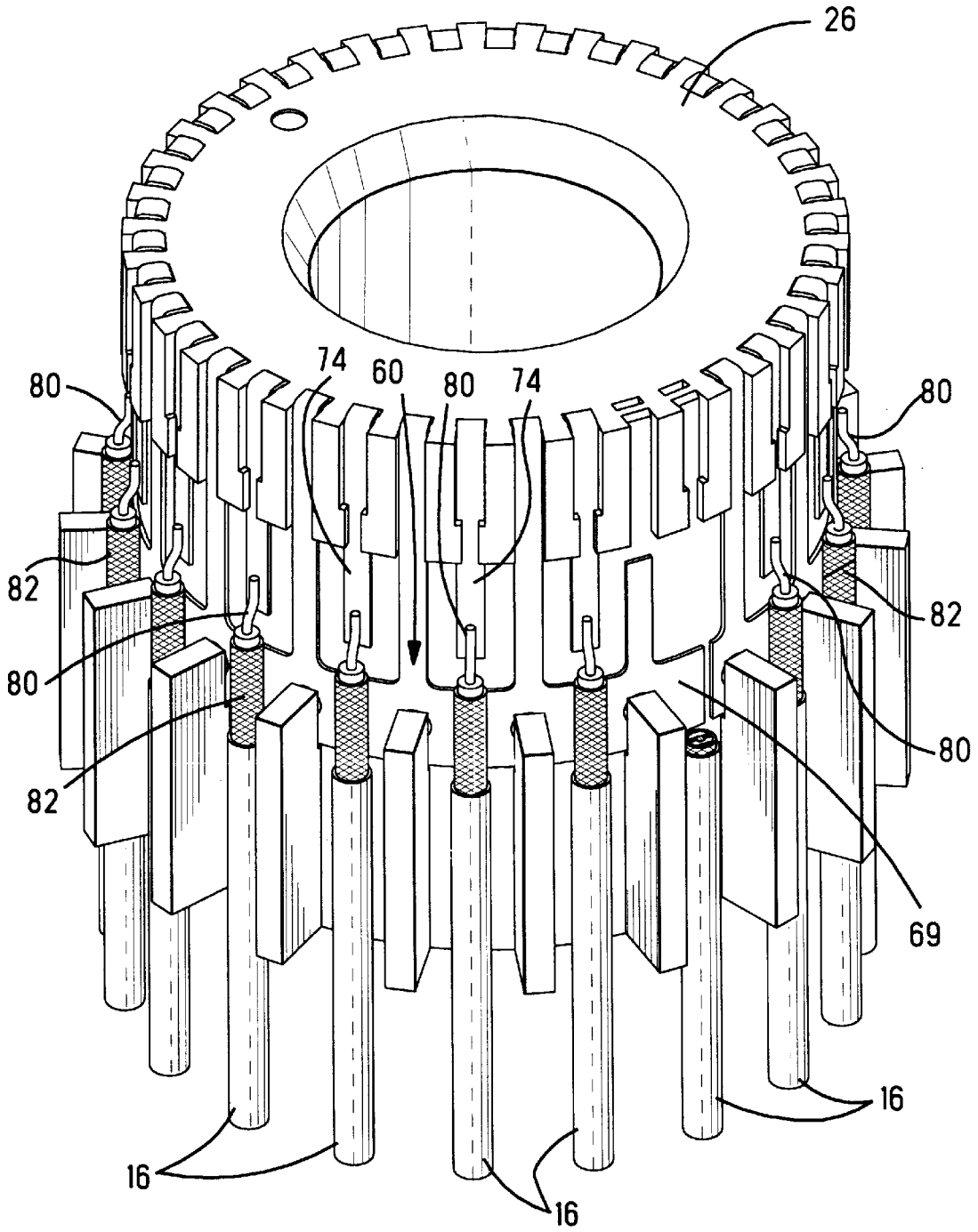
FIG. 7 is an isometric view of the coaxial cables mounted and secured to the contact housing.

FIG. 7 shows the assembly of the individual coaxial cables 16 which are received from the cable 12 and secured to the contacts on the contact housing 26. The individual coaxial cables 16 are prepared by exposing the central signal contact 80 and the outer shielding braid 82. The individual coaxial cables 16 are aligned between the ribs 54 and the shielding braid 82 is laid against the carrier strip portion 69 of ground contact strip 60 and secured thereto by soldering or some other means. The ground contact strip 60 provides a common ground for all of the coaxial cables 16. The signal contacts 80 are then secured to the individual signal contacts 74. All of the cables 16 are secured in a similar manner about the periphery of the contact housing 60.

Figure 8:
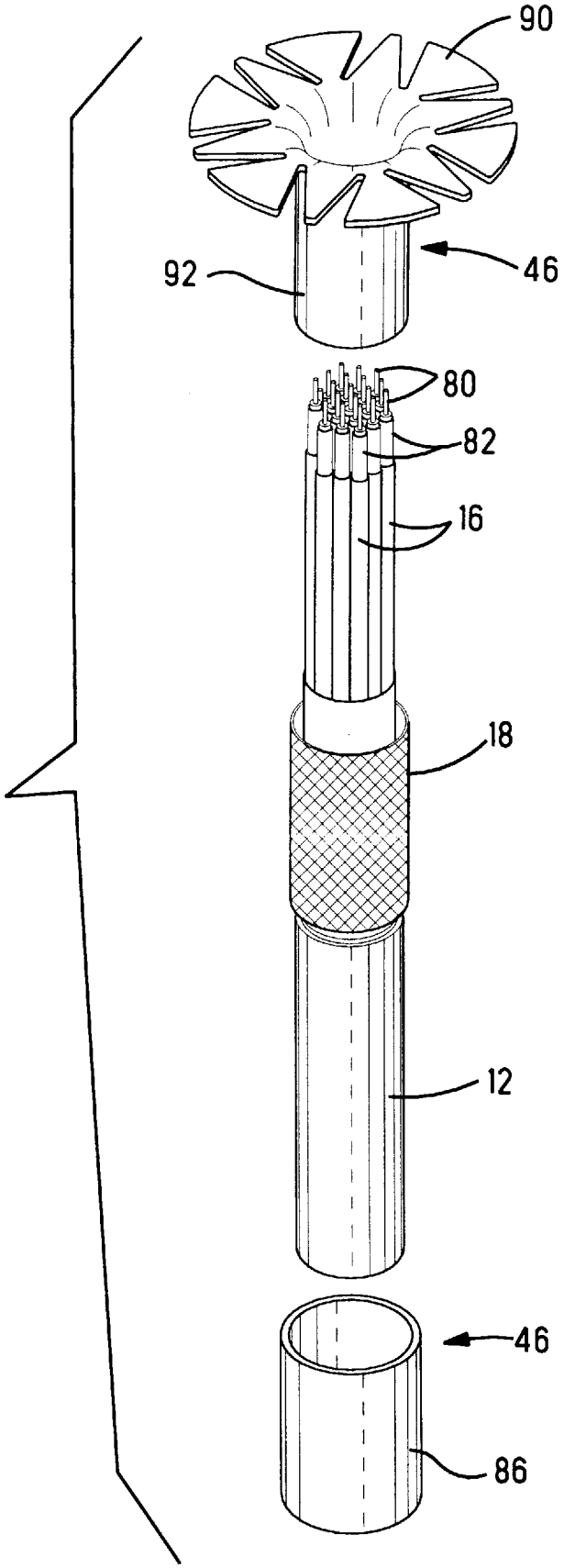
FIG. 8 is an exploded isometric view showing the assembly of the strain relief.

FIG. 8 shows the assembly of the strain relief 46 onto the cable 12. As described earlier the cable 12 houses a plurality of coaxial cables 16, or some other type of cable, and further has a shielding braid 18 secured around all of the coaxial cables. The strain relief 46 consists of two parts, one part being the outer securing portion 86 and the other part being the inner sleeve 92 having the contact fingers 90 extending from a top thereof. During assembly, the sleeve 92 is received along the inside portion of the braid 18. The outer securing portion 86 is received over top of the braid 18, and the whole strain relief 46 is then crimped onto the outer shielding braid providing an electrical connection between the braid and the strain relief. The strain relief 46 provides both electrical connection to the shielding braid 18 of cable 12 and also strain relief for the cable 12 to prevent the cable from being easily broken. As can be seen from FIG. 3, the contact fingers 90 on the strain relief 46 are received within a slot 94 on the housing 20. The contact fingers 90 then provide electrical connection between the strain relief 46 and the outer housing to provide shielding of the entire connector. The shielding is provided from the cable via the outer shielding braid 18 to the housing.

Figure 2:
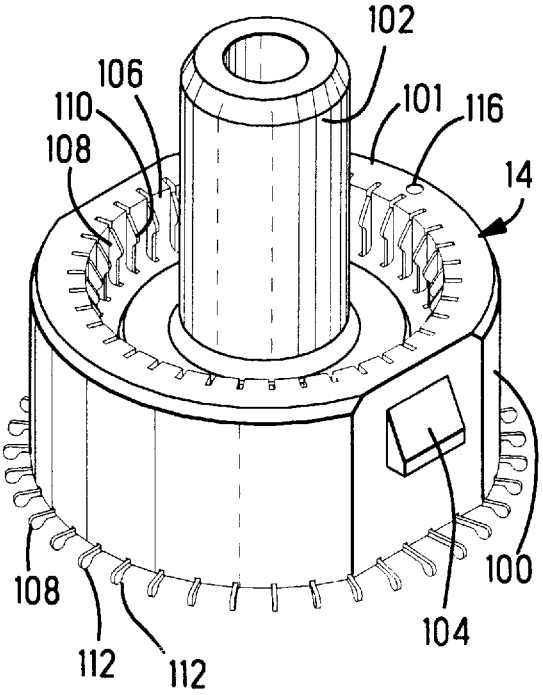
FIG. 2 is an isometric view of the receptacle connector of the present invention.

FIG. 2 shows the receptacle connector 14 of the present invention. The receptacle connector has a housing 100 with a mating interface 101. Extending from the mating interface is alignment post 102. The alignment post is to be received within the alignment hole 28 on the plug connector 10. Around the outer sides of the housing are latching protrusions 104. The latching protrusions 104 are designed to engage the latching surfaces 40 on the latching arms 22. This interaction will secure the connectors together making it easy to release them when necessary. Along the mating interface 101 is inner wall 106. Disposed within the housing 100 are a plurality of substantially identical contacts 108.

The contacts 108 have contacting surfaces 110 which will engage the contacts 60, 74 disposed about the periphery of the contact housing 26. The contacts 108 also have surface mount sections 112 which extend outwardly from the bottom surface of the housing 100. The surface mount portions 112 will be electrically connected to contact pads disposed on the printed circuit board, not shown.

When the plug connector 14 and the receptacle connector 10 are mated, the alignment post 102 will be received within the alignment hole 128 thereby ensuring that they are properly aligned. The latching arm 22 will engage the latching protrusions 104 to secure the two connectors together The contact housing 26 will be received within the inner wall 106 so that the contacts within the receptacle plug 14 can engage the contacts 62, 74 on the outer periphery of the contact housing 26. Further alignment of the mating connectors can be brought about by using the alignment holes 114, 116 on the mating connectors to ensure that they are properly aligned with each other and the contacts are properly oriented.

The contacts mounted in either the plug connector 10 or the receptacle connector 14 can have a gold mating interface along the contacting surface to provide a good contact surface.

Figure 9:
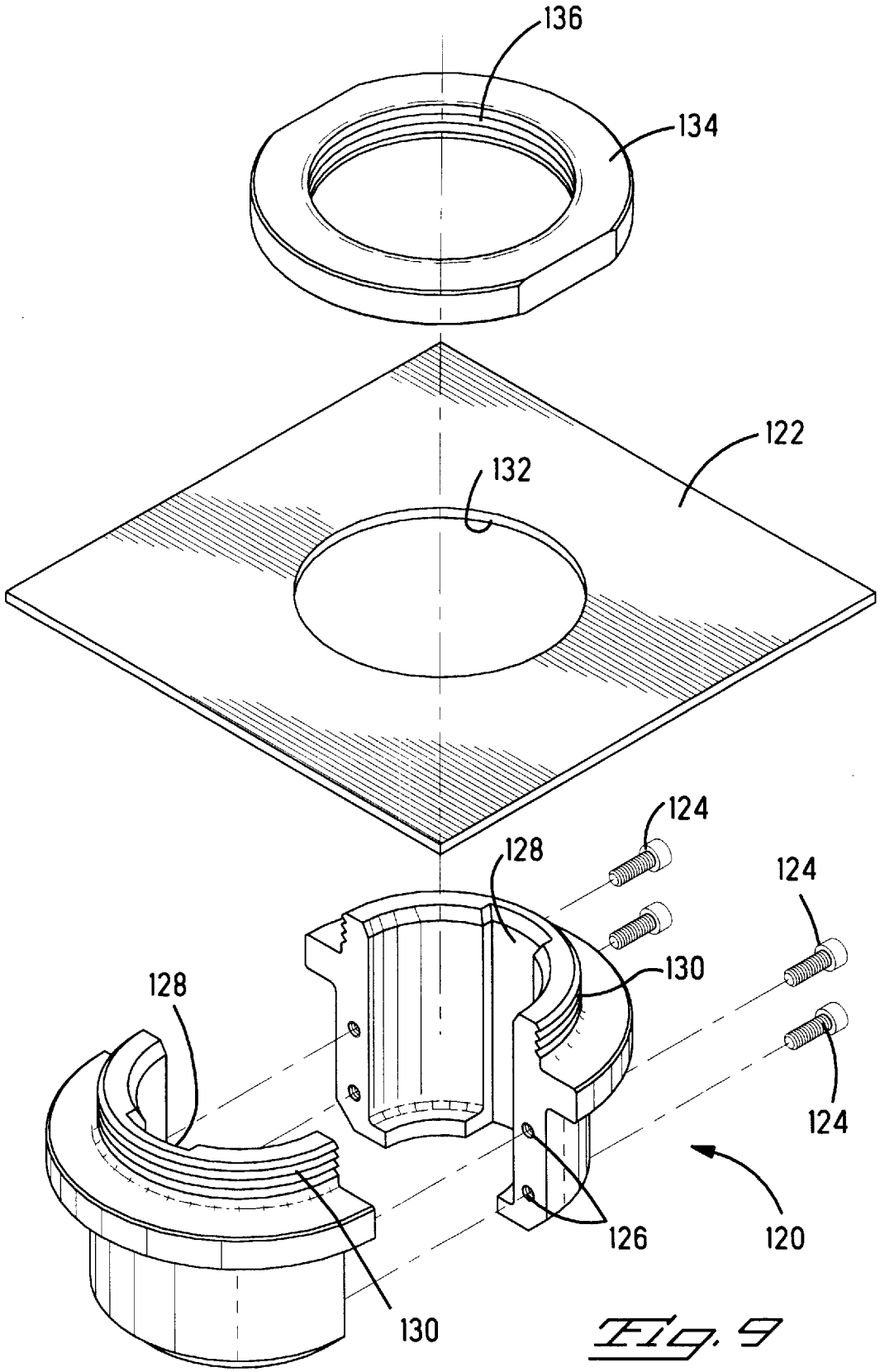
FIG. 9 is an isometric view of the bulk head securing assembly.

FIG. 9 shows housing 120 which is used to secure the receptacle and plug connectors to bulk head 122. Housing 120 is a two part housing, the parts are secured together by screws 124. The screws 124 are secured through tap holes 126 to secure the two halves of the housing together. The housing 120 is secured over the receptacle connector which has already been mounted onto the printed circuit board. The latching protrusions 104 are received within slots 128 to allow the receptacle to be mated with the plug connector. Along the top surface of the housings 120 are threaded portions 130. The threaded portions are received through a through hole 132 in the bulk head 122.

Retaining head 134 has inner-threaded surfaces 136. The retaining head 134 is received over the plug connector 10 and the inner-threaded surfaces 136 will engage the threaded section 130 on the housing 120 thereby securing the retaining head 134 and the housing 120, and therefore the plug in the receptacle connectors, to the bulk head. The engagement of the retaining head 134 with the housing 120 will secure these parts on either side of the bulk head.

Figure 10:
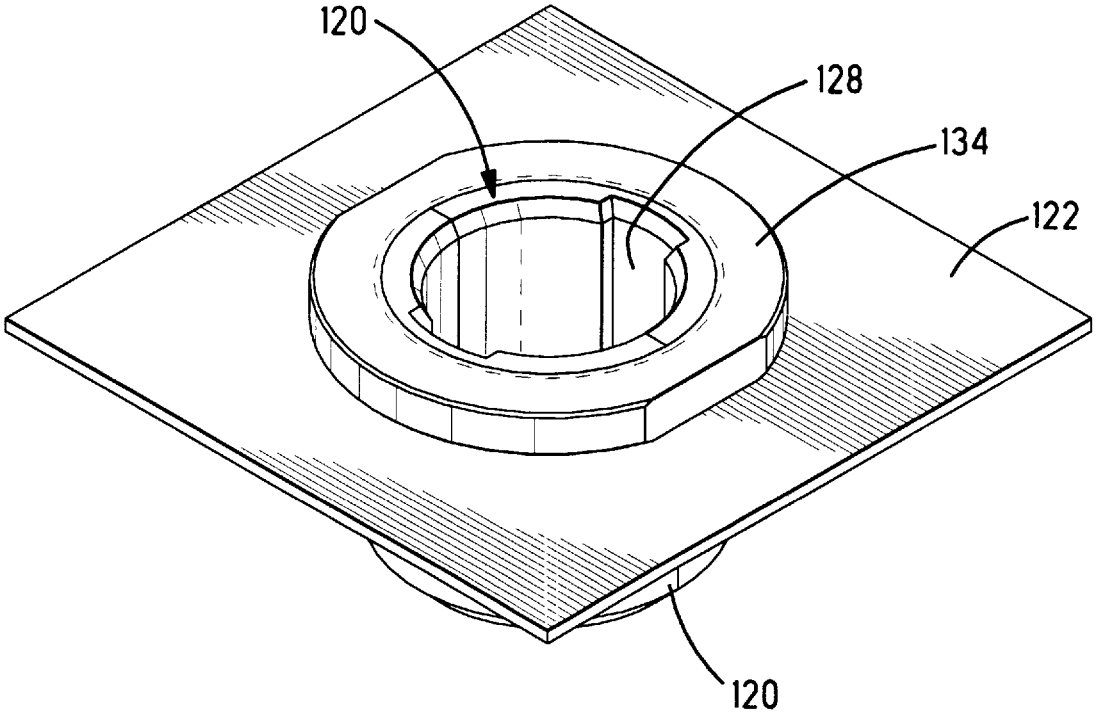
FIG. 10 is an assembled isometric view of the bulk head securing assembly.

FIG. 10 shows the housing 120 and the retaining head 134 secured to either sides of the bulk head. The plug and receptacle connectors will be secured along the inner portion of the housing 120 and thereby secured to the bulkhead.

Figure 11:
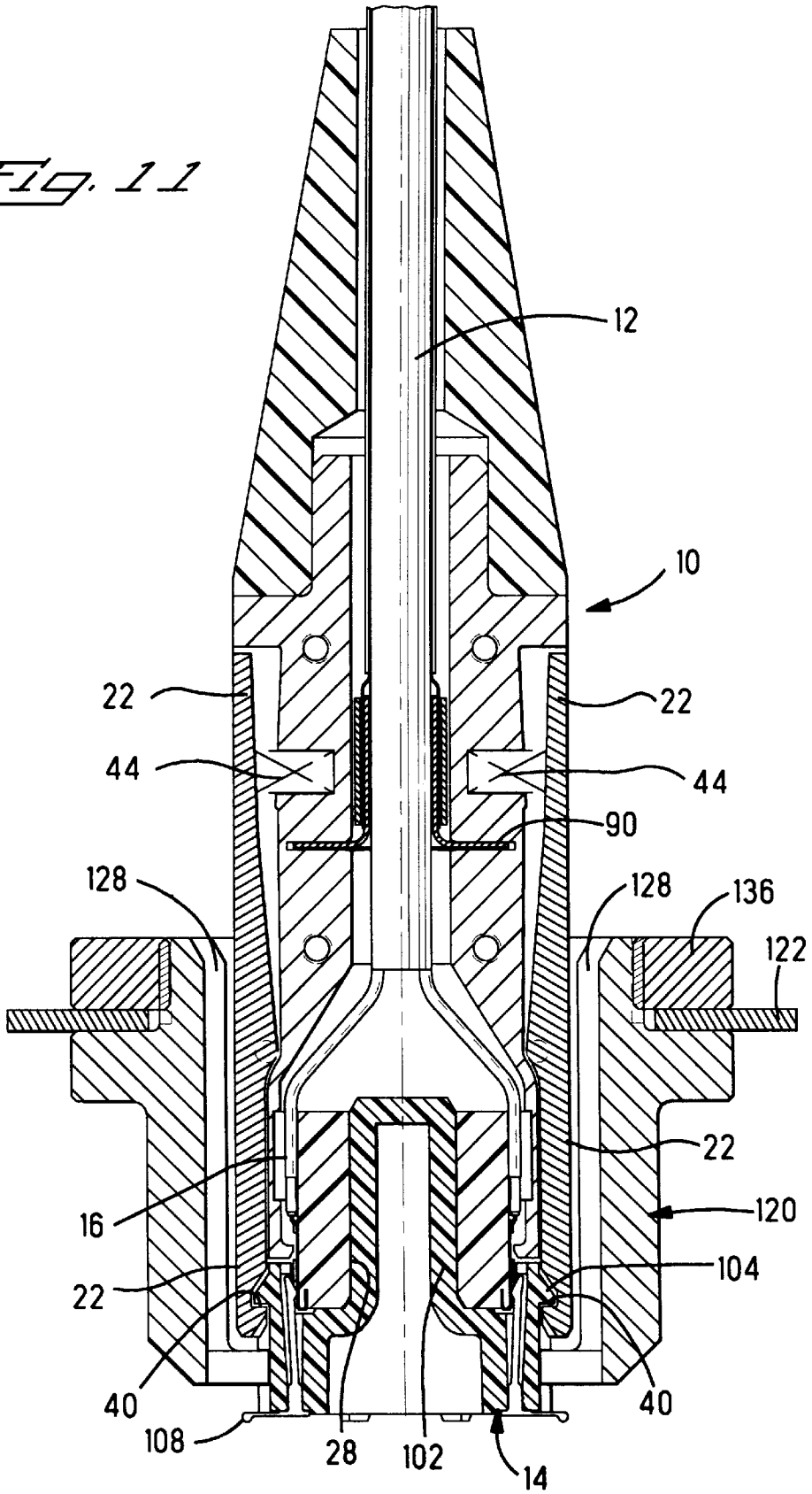
FIG. 11 is a cross-sectional view of the bulk head securing assembly as it secures the plug and receptacles connectors of the present invention.
Figure 12:
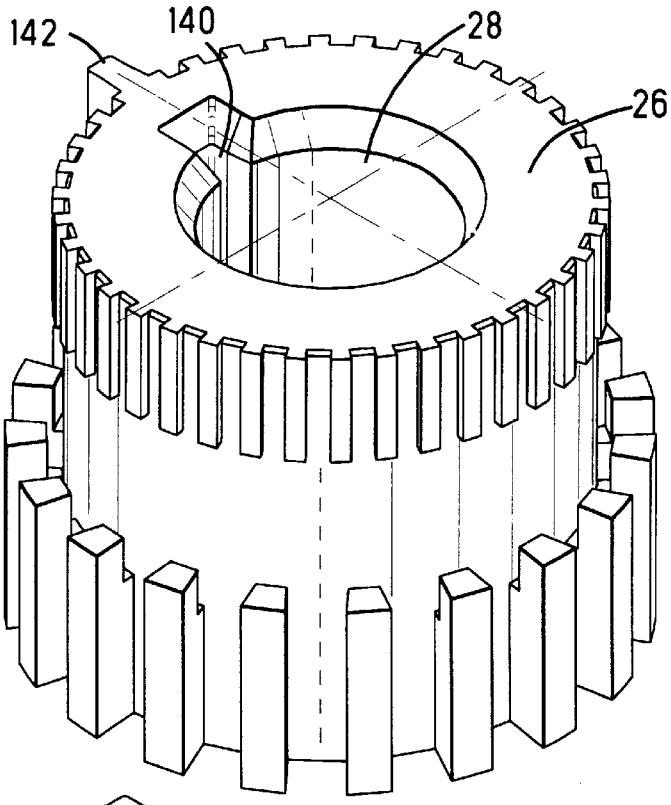
FIG. 12 is an isometric view of an alternative embodiment of the contact housing.

FIG. 11 shows a cross-sectional view of the bulk head assembly and the plug 10 and receptacle connectors 14 assembled to the bulkhead 122. The receptacle connector 14 is received within the housing 120. Slots 128 are aligned with the latching protrusions 104 to allow latching and unlatching with latching arms 22. The surface mount sections of contacts 108 extend below the housing 120 to accommodate the electrical connections with a circuit board, not shown. The retaining head 134 is received over the top of the housing 120 to secure the whole assembly to the bulkhead 122.

FIG. 11 also shows the assembly of the plug connector 12. The springs 44 engage the inner surface of the latching arms 22 and the fingers 90 engage the housing 20 to provide electrical connection between the braid on the cable 12 and the housing.

Figure 13:
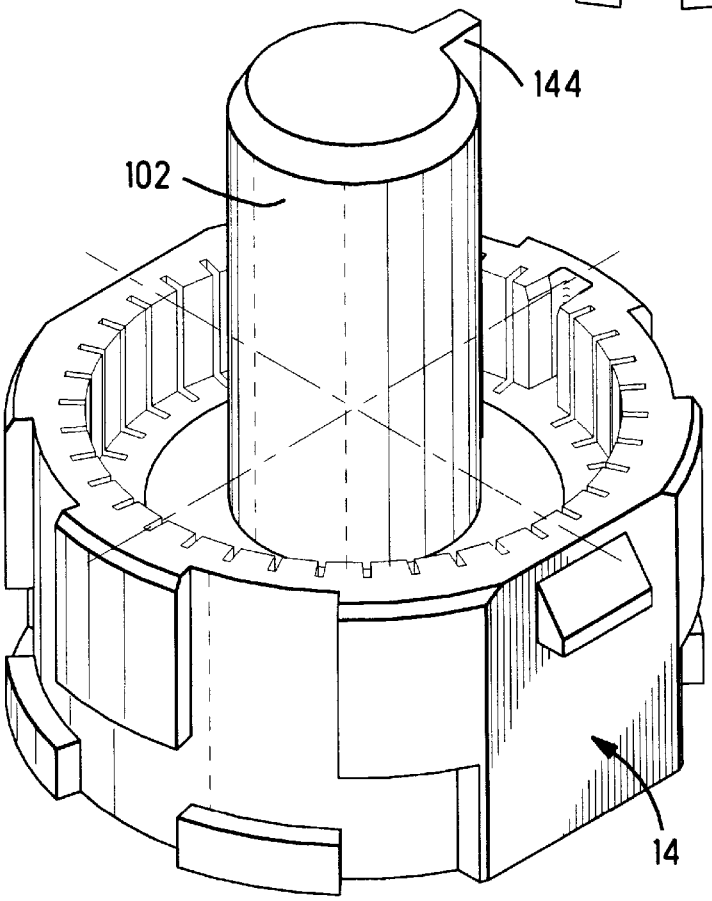
FIG. 13 is an isometric view of an alternative embodiment of the receptacle connector.

FIGS. 13 and 14 show alternative embodiments of the contact housing and the receptacle connector, in which like features will have the same reference numeral. FIG. 13 shows the contact housing with a keying feature. The keying feature is made of a slot 140 disposed along the alignment hole 28. Further, disposed along the outer periphery of the contact housing 26 is keying projection 142. The receptacle connector 14 has a keying projection 144 disposed along the alignment post 102. When the plug 10 and the receptacle connectors 14 are mated, keying projection 144 will be received within the slot 140 disposed within the alignment hole 28. Further, the keying projection 142 will interact with a similar keying slot on the housing 20, not shown. The keying feature allows the contacts on both the plug 10 and the receptacle connectors 14 to be properly aligned with each other fore mating.

The plug and receptacle connectors of the present invention and many of their attendant advantages will be understood from the foregoing description. It is apparent that these changes may be made in the form, construction, an arrangement of parts thereof without departing from the spirit or scope of the invention, or sacrificing all of their material advantages.

What is claimed is:

1. An electrical connector for providing connection for a plurality of coaxial cable disposed in a shielded cable, comprising:

a contact housing having plurality of signal and ground contacts mounted therein, the contact housing having an outer circular periphery, the signal and ground contacts being disposed about the outer periphery of the contact housing, the signal and ground contacts each having contact sections and connection sections for forming a coaxial cable.

2. The electrical connector of claim 1, wherein a circular outer housing is disposed about the contact housing.

3. The electrical connector of claim 1, wherein the ground contacts having contact sections and having a carrier strip from which all of the ground contacts extend, the carrier strip providing a connection section to which a shielding braid of the coaxial cable will be secured and the carrier strip providing a commoning of the ground contacts and the shielding braid.

4. The electrical connector of claim 2, wherein the outer housing is metal.

5. The electrical connector of claim 4, wherein a strain relief is disposed over an outer braid of the cable, the cable having a plurality of the coaxial cable therein, the strain relief having fingers for electrical connection with the outer housing for providing a ground connection to the outer braid.

6. The electrical connector of claim 5, wherein the strain relief is composed of an outer sleeve and an inner sleeve, the inner sleeve being received along the inner side of the shielding braid, the outer sleeve being received along the outer side of the shielding braid and the inner and outer sleeves being crimped to the braid, the strain relief providing both strain relief for the cable and a grounding connection.

7. The electrical connector of claim 2, wherein the outer housing has two latching arms disposed along either side, the latching arms having a first engaging position and a second position in which a mating connector can be mated or released from the outer housing, the latching arms having protrusions, latching surfaces and pushing surfaces, the outer housing having recesses into which the protrusions are received to allow the latching arms to rotate therearound, the outer housing having springs which engage the latching arms, actuation of the pushing surfaces pushes the latching arms against the spring and moves the latching surfaces into the second position, upon release of the pushing surfaces, the springs push the latching arms back to their first position so that the latching surfaces engage the mating connector.

8. The electrical connector of claim 1, wherein a series of slots extend along an outer side of the contact housing for receiving the contacts therein.

9. The electrical connector of claim 8, wherein the contacts have contact sections which are received within the slots and secured therein, the contacts having bent over portions and the housing has recesses, the bent over portions are received within the recesses.

10. The electrical connector of claim 9, wherein the ground contacts are formed as part of a contact strip, the strip having a carrier portion which commons all of the ground contacts together, the ground contacts extending from the carrier strip to be received within the slots, the slots having alternating signal contacts and ground contacts therein.

11. The electrical connector of claim 10, wherein the coaxial cable have shielding braids which are secured to the carrier portion of the contact strip and the coaxial cables having a signal conductors which are soldered to the individual signal contacts.

12. An electrical connector, comprising:

a contact housing having a circular periphery, a plurality of alternating ground and signal contacts disposed about the periphery of the contact housing, the signal contacts having contact sections and connecting sections for being secured to a signal contact in a coaxial cable, the ground contacts having contact sections and a connection section, the connection section providing a place to which a shielding braid of the coaxial cable will be secured and the carrier strip providing a commoning of the ground contacts.

13. The electrical connector of claim 12, wherein a circular outer housing is disposed about the contact housing.

14. The electrical connector of claim 13, wherein the outer housing is metal.

15. The electrical connector of claim 14, wherein a strain relief is disposed over an outer braid of cable, the cable housing a plurality of the coaxial cable therein, the strain relief having fingers for electrical connection with the outer housing for providing a ground connection to the outer braid.

16. The electrical connector of claim 15, wherein the strain relief is composed of an outer sleeve and an inner sleeve, the inner sleeve being received along the inner side of the shielding braid, the outer sleeve being received along the outer side of the shielding braid and the inner and outer sleeves being crimped to the braid, the strain relief providing both strain relief for the cable and a grounding connection.

17. The electrical connector of claim 12, wherein the outer housing has two latching arms disposed along either side, the latching arms having a first engaging position and a second position in which a mating connector can be mated or released from the outer housing, the latching arms having protrusions, latching surfaces and pushing surfaces, the outer housing having recesses into which the protrusions are received to allow the latching arms to rotate therearound, the outer housing having springs which engage the latching arms, actuation of the pushing surfaces pushes the latching arms against the spring and moves the latching surfaces into the second position, upon release of the pushing surfaces, the springs push the latching arms back to their first position so that the latching surfaces engage the mating connector.

18. An electrical connector assembly, comprising:

a plug connector having a plurality of signal and ground contacts mounted therein, the contact housing having a circular outer periphery, the signal and ground contacts being disposed about the outer periphery of the contact housing, the signal and ground contacts each having contact sections and connection sections for forming an electrical connection with the signal and ground from a coaxial cable;

a receptacle connector having a plurality of contacts disposed about an inner wall to provide an electrical connection with the signal and ground contacts of the plug connector, the contacts of the receptacle connector having a surface mount section to allow surface mount connection to a circuit board, whereby the assembly allows a plurality of coaxial cables to be connected to a circuit board.

19. The electrical connector assembly of claim 18, wherein the plug connector has a circular contact housing having a plurality of signal and ground contacts mounted therein, the contact housing having an outer periphery, the signal and ground contacts being disposed about the outer periphery of the contact housing, the signal and ground contacts each having contact sections and connection sections for forming an electrical connection with the signal and ground from a coaxial cable, the receptacle housing having an inner wall with a plurality of contacts disposed about the inner periphery of the inner wall, upon mating of the plug and receptacle, the inner wall is received about the outer periphery of the contact housing so that the contacts on the plug and the receptacle connectors are mated.

20. The electrical connector assembly of claim 18, wherein the plug connector has an alignment post and the receptacle connector has an alignment hole, the post being received within the hole to provide proper mating alignment between the plug and receptacle connector.

21. The electrical connector assembly of claim 20, wherein the alignment post and the alignment hole have a keying assembly to allow proper mating orientation of the connectors.

* * * * *